US008328111B2

(12) United States Patent
Mielke et al.

(10) Patent No.: US 8,328,111 B2
(45) Date of Patent: Dec. 11, 2012

(54) ROADWAY SYSTEM FOR MODEL VEHICLES WITH ENERGY-INDEPENDENT PROPULSION

(75) Inventors: Hendrik Mielke, Furtwangen (DE); Gerhard Kaltenbach, Gundelfingen (DE)

(73) Assignee: Gebr. Faller GmbH, Guetenbach (DE)

( * ) Notice: Subject to any disclaimer, the term of this patent is extended or adjusted under 35 U.S.C. 154(b) by 34 days.

(21) Appl. No.: 13/015,568

(22) Filed: Jan. 27, 2011

(65) Prior Publication Data

US 2011/0186645 A1 Aug. 4, 2011

(30) Foreign Application Priority Data

Jan. 29, 2010 (DE) ..... 20 2010 001 571 U

(51) Int. Cl.
*E01B 23/00* (2006.01)

(52) U.S. Cl. ..... 238/10 A; 238/10 R

(58) Field of Classification Search ..... 238/10 R, 238/10 A, 10 C, 10 E, 10 F; 446/444, 445, 446/446
See application file for complete search history.

(56) References Cited

U.S. PATENT DOCUMENTS

| | | | | |
|---|---|---|---|---|
| 2,794,929 | A * | 6/1957 | Adamski | 310/12.22 |
| 4,091,995 | A * | 5/1978 | Barlow et al. | 238/10 A |
| 6,883,720 | B2 * | 4/2005 | D'Angelo, Jr. et al. | 238/10 E |
| 6,935,574 | B2 * | 8/2005 | Cheng | 238/10 B |
| 7,354,006 | B1 * | 4/2008 | Bricker | 238/10 R |
| 7,963,456 | B2 * | 6/2011 | Stadlbauer | 238/10 F |
| 2003/0136857 | A1 * | 7/2003 | Han | 238/10 A |
| 2004/0182947 | A1 * | 9/2004 | Wa | 238/10 R |
| 2005/0098645 | A1 * | 5/2005 | Cheng | 238/10 R |
| 2007/0057080 | A1 * | 3/2007 | Ngai | 238/10 F |
| 2008/0265049 | A1 * | 10/2008 | Stadlbauer | 238/10 F |
| 2010/0279582 | A1 * | 11/2010 | Bailly | 446/444 |
| 2011/0003530 | A1 * | 1/2011 | Haass et al. | 446/444 |
| 2011/0042473 | A1 * | 2/2011 | Hesse | 238/10 A |
| 2011/0186645 | A1 * | 8/2011 | Mielke et al. | 238/10 A |
| 2012/0071063 | A1 * | 3/2012 | Mataya | 446/444 |

FOREIGN PATENT DOCUMENTS

| | | |
|---|---|---|
| CH | 278624 | 10/1951 |
| CN | 2604128 | 2/2004 |
| DE | 1 736 543 | 12/1956 |
| DE | 49580 | 10/1966 |
| DE | 1963659 | 6/1971 |
| DE | 1678393 | 12/1971 |

(Continued)

OTHER PUBLICATIONS

German Pat. Appln. Serial No. 20 2010 001 571.5, German Search Report dated Dec. 3, 2010, 4 pages, English translation, 3 pages.

(Continued)

*Primary Examiner* — Jason C Smith
(74) *Attorney, Agent, or Firm* — Andrew F. Young, Esq.; Lackenbach Siegel, LLP

(57) ABSTRACT

The invention concerns a roadway system, the system for use with model vehicles with an energy-independent propulsion as well as a steering axle, which follow a driving wire laid directly beneath the roadway by means of a magnet, wherein the roadway system comprises individual, generally two-dimensional (meaning generally long and thin in cross section) roadway segments each having multiple respective connection edges and at least one groove on their roadway side with a diameter to accommodate the driving wire. The roadway system comprises straight, curved, flexible, and special-type roadway segments.

14 Claims, 4 Drawing Sheets

FOREIGN PATENT DOCUMENTS

| | | | |
|---|---|---|---|
| DE | 3409975 | | 9/1985 |
| DE | 29615745 | U1 | 12/1996 |
| DE | 69836856 | | 9/2007 |
| EP | 0072375 | | 9/1981 |
| EP | 1 530 989 | | 5/2005 |
| JP | 3614881 | | 1/2005 |

OTHER PUBLICATIONS

European Search Report for Appn. No. 11 00 0486.8 Dated May 24, 2011, 6 pages German, 2 pages in English, Comments and References.

* cited by examiner

ROADWAY SYSTEM FOR MODEL VEHICLES WITH ENERGY-INDEPENDENT PROPULSION

CROSS REFERENCE TO RELATED APPLICATIONS

This Application relates to and claims priority from German Patent Application Ser. No. 20 2010 001 571.5 filed Jan. 29, 2010, the entire contents of which is incorporated herein fully by reference.

FIGURE FOR PUBLICATION

FIG. 1.

BACKGROUND OF THE INVENTION

1. Field of the Invention

The present invention relates to a roadway system for model vehicles with an energy-independent propulsion, e.g., a battery or other energy-independent power supply, propulsion as well as a steering axle, where the model vehicles follow a driving wire laid directly beneath the roadway with the help of a magnet.

2. Description of the Related Art

The related art involves roadway systems for model vehicles that are outfitted with an energy-independent electric motor are known and are based on the model vehicles having a steering axle and following a driving wire laid directly beneath the roadway with the help of a magnet. The vehicles are outfitted with an independent power supply for the propulsion, such as a battery or a rechargeable battery, and can move independently on the given driving stretch until the battery for the power supply is exhausted. The roadway systems designed for this can be controlled by means of functional elements, and the vehicles can be individually halted and started again or also steered to different lanes or parking places, etc. in a limited manner.

The corresponding roadways are constructed by individual milling of grooves, followed by laying of the driving wire, covering up the driving wire with filler, and then painting the roadway. Another option is to use a so-called box roadway, for which box segments are available that have pre-punched grooves for laying the driving wires, which are then covered by gluing on special roadway foils. In addition, roadway systems made from plastic roadway parts are known, in which the special driving wire is already integrated into the plastic profile.

CH 278 624 A, the entire contents of which are incorporated herein by reference, describes a toy that comprises a vehicle that can move independently on a trackless driving bed. An iron wire is embedded in the driving bed and enters into an active connection with a control magnet for the vehicle, while the vehicle itself can be propelled by an electric motor. The driving bed can also be composed of separate pieces, which are held together by means of clips.

DE 296 15 745 U1, the entire contents of which are incorporated herein by reference, describes a modular road system for magnetically driven model cars, in which pieces of road, stopping places and junctions can be put together to construct or take apart a road system in the shortest possible time.

Those of skill in the art recognize that the systems and solutions used thus far have drawbacks, including the drawback that they leave too little room for an individual configuring of the course of the road, which also holds especially for the systems with prefabricated segments, although they have the benefit of being constructed with relatively little expense.

Unfortunately, the individual cutting of grooves in a corresponding base surface, on the other hand, is time consuming, costly, and also presents the user with the problem, in particular, that the choice of the correct radii for negotiating curves and the functional installation of driving wire and functional elements involve difficulties, large equipment expenditure, and frequent mistakes.

The problem of the present invention is thus to offer a roadway system that does not have the above-mentioned problems and enables comprehensive adaption to the use-challenges identified in the related art.

Accordingly, there is a need for an improved roadway system for model vehicles.

ASPECTS AND SUMMARY OF THE INVENTION

The system according to the present invention provides for a roadway system for model vehicles with an energy-independent propulsion as well as a steering axle, which follow a driving wire laid directly beneath the roadway by means of a magnet, wherein the roadway system comprises individual, two-dimensional (meaning having a generally thin cross section and a broad width with a longer length) roadway segments having at least two connection edges, being approximately 1 to 5 mm thick, while the individual roadway segments have at least one groove on their roadway side with a diameter of generally 0.1 to 1.0 mm to accommodate the driving wire, while the roadway system comprises straight roadway segments, curved segments, flexible roadway segments, and special roadway segments, that are adapted for the particular purpose for roadway use of model vehicles.

For the solving of the aforesaid problem, a roadway system is provided that is constructed from individual, two-dimensional roadway segments, each having at least two connection edges and preferably two side edges. These segments are designed especially for scale model vehicles that have an energy-independent propulsion, as well as a steering axle, and that follow a driving wire laid directly beneath the roadway by means of a magnet. The roadway segments each consist of base elements that are 1 to 5 mm thick, preferably around 3 mm thick, having a groove on at least one side with a diameter of 0.1 to 1.0 mm, preferably around 0.5 mm, to accommodate the driving wire.

At their respective connection edges, the roadway segments have dovetailing (interlocking) connection elements fashioned as corresponding mating pieces, by which the individual roadway segments are joined together by form fitting. One preferred embodiment of this type of connection calls for the connection elements to be configured similar to the connections of puzzle pieces, a first connection element at the first connection edge being fashioned as a tongue sticking out beyond the first connection edge and broadening, while the corresponding second connection element is fashioned as a receiving opening receding from the second connection edge and narrowing toward the connection edge. The connection elements are configured so that the connection edges and the connection elements produce a form fit when the individual roadway segments are connected.

Preferred as the starting material for the base elements is plywood around 3 mm thick, which has the advantage over plastic materials that it can be worked by laser cutting technology, so that an extreme fitting accuracy of the roadway segments can be assured. What is more, this material possesses outstanding bending properties allowing adaptation to twisting, sloped, and curved environments and, furthermore, is excellently suited for installation of functional elements in it or directly underneath. For this, corresponding boreholes, shoulders and markings are provided on the roadway segments, which serve as installation aids for electromagnetic, electromechanical and/or electronic functional elements. Furthermore, the wood surface is excellently suited for further processing, such as painting, caulking, gluing or other work to provide the surface with a realistic appearance. Of course, any other wood or plastic materials can be used. In this context, it should also be pointed out that processing methods other than laser cutting technology can also be used, of course, such as milling cutting, as long as the methods provide an adequate fitting accuracy.

The roadway system calls for all standard segments having the same width and in general all roadway segments having the same connection elements, so that all segments can be freely combined with each other.

The groove for the driving wire is designed so that the driving wire in the installed state is fitted in the groove with no play. Thus, the diameter of the groove corresponds to the diameter of the driving wire and the groove after the driving wire is installed can be filled with a little bit of filler and then be painted, thereby giving the roadway a realistic appearance, not disturbed by any visible cables or track grooves.

Altogether, the roadway system comprises at least four different kinds of roadway segments, namely, straight roadway segments, curved segments, flexible roadway segments and special roadway segments (which are adaptable to a variety of roadway system requirements to enhance the advantages of the current invention).

While the individual straight roadway segments differ only in their length, as well as the number and arrangement of the stopping points, and the groove for the driving wire is always arranged at the center of the roadway, additional variations are required for the curved segments in order to achieve the broadest possible range of application for the individual curved segments.

Thus, in one alternative aspect of the present invention, the curved segments have a two-part groove, the first part of the groove in the course of the curve leading from the middle of one connection edge outwardly into the region of the outside curve and there in the center region a short piece runs parallel to the outside edge and then comes back again to the middle of the opposite connection edge. The second part of the groove is disposed for the entire curved segment parallel to the curved path in the outside curve region. Thus, in the middle region of the curved segment, both grooves have a common path parallel to the side edge. Thus, thanks to this special routing of the driving wire, it is possible to dynamically counterbalance the swinging out of the vehicles in the curve during use and thereby prevent the vehicles from leaving the given driving path.

To ensure the broadest possible application for the individual curved segments, an individual curved segment has one eighth of the circumference of a circle, so that the prolongations of the two connection edges of the curved segment make an angle of 45°. Altogether, therefore, eight curved segments form a full circle.

In order to realize at least a two-lane traffic flow in the curved region as well, at least two different curved segments are provided, the second curved segment having a different radius, adapted to the radius of the first curved segment, so that the two curved segments can be combined seamlessly with each other to form a two-lane roadway.

Another peculiarity and advantageous configuration of the roadway system of the invention calls for having grooves to accommodate a driving wire on both sides in the curved segments, so that the individual curved segments can be used for left and right curves by simple exchanging of sides.

Based on the special driving wire routing in the region of the curved segments, where the path to be chosen for the vehicle depends on the particular use of the curved segment, in one alternative advantageous embodiment of the curved segment there are four boreholes provided to accommodate reed switches (reed switches are known to those of skill in the art), which simplifies the installation of corresponding sensors by the user. Similar boreholes are also provided in the straight roadway segments, but in this case due to the more simple driving wire routing preferably only two or three boreholes per segment are provided. In all roadway segments, it is possible to provide recesses, shoulders or markings that run from the boreholes, so that the precise installation of functional elements is facilitated and made possible, not only simplifying the construction of the driving system in this way, but also in particular avoiding malfunctions of the functional elements.

The third type of roadway segments are the so-called flexible roadway segments, which are configured as (pre-use) straight segments with a serpentine structure having regular recesses made on either side in alternation and running across the middle of the width of the roadway. Thanks to this special structurization, these roadway segments have a high flexibility during use and can thus be (during use installation) bent to any desired radius or curvature, or twist—even away from a support surface in a vertical dimension, so that the user can form connections not possible with the previously described standard segments.

Beyond the above three standard roadway segments described, other individual so called special roadway segments are adaptively provided and envisioned by the inventors to meet with track requirements, which are provided as connection sites or junctions to other segments, as merging lanes, intersections, grade crossings or other complete functional scenarios. Those of skill in the art will recognize that these special roadway segments are definitively defined by this label and understood as such and designed so that they can be combined with the standard segments seamlessly, with the boreholes, recesses, shoulders and markings necessary for the operation of the special segments being provided already in the roadway segments.

The special advantage of the roadway system according to the invention is that it is able with few standardized roadway segments to realize a road construction with an individual traffic flow. The roadway system contains only four groups of standardized roadway segments, namely, straight roadway segments, curved segments, flexible roadway segments and special roadway segments, which allow the user to realize a road landscape adapted to his individual requirements without major labor and equipment expense.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
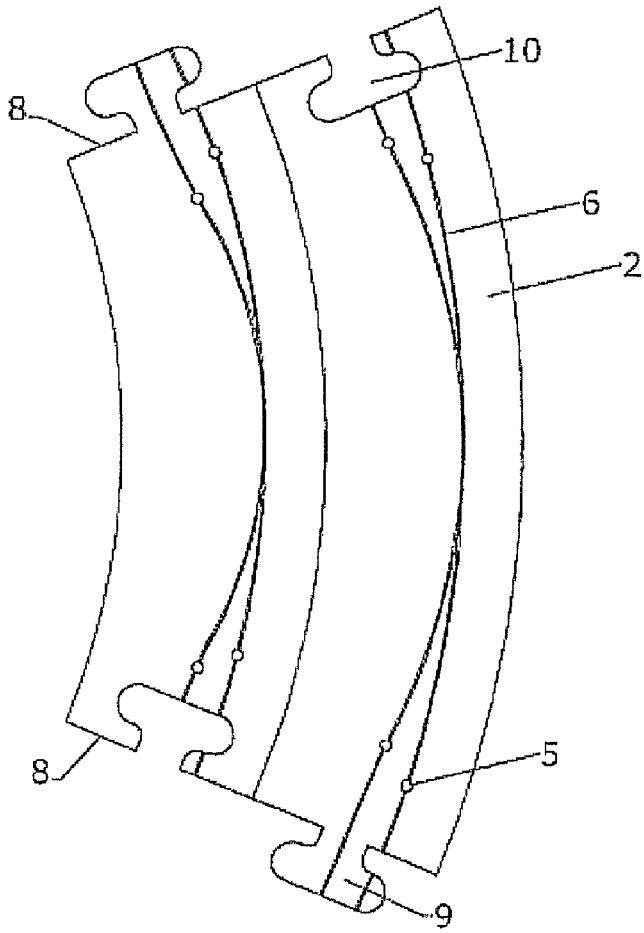
FIG. 1 provides a depiction of a combination of two different curved segments.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

FIG. 1 shows the combination of two different curved segments 2, whose radii are matched to each other so that a seamless curve is achieved for a two-lane roadway. The two 2-dimensional curved segments 2 have an oblong shape and have two connection edges 8 at either end, which can be joined to each other by connection elements 9, 10, the connection elements 9, 10 being configured as corresponding mating parts and forming a kind of dovetail connection. The connection elements 9, 10 in the present specific instance resemble a connection of puzzle pieces, where a first connection element 9 is fashioned as a tongue sticking out beyond the first connection edge and broadening, while the corresponding second connection element 10 is present as the corresponding receiving opening, which is formed back from the connection edge 8 and narrows toward the connection edge 8, so that a dovetailing bond is formed. The present drawing further shows the two-part nature of the groove 6, where a first part of the groove 6 starting from the middle of one connection edge 8 runs outwardly into the region of the outside curve and then back again to the middle of the opposite connection edge 8, while the second part of the groove 6 is disposed parallel to the curved path in the outside curve region. The two parts of the groove 6 are combined with each other so that they have a common path parallel to the side edge in the middle section of the curved segment 2.

Figure 2:
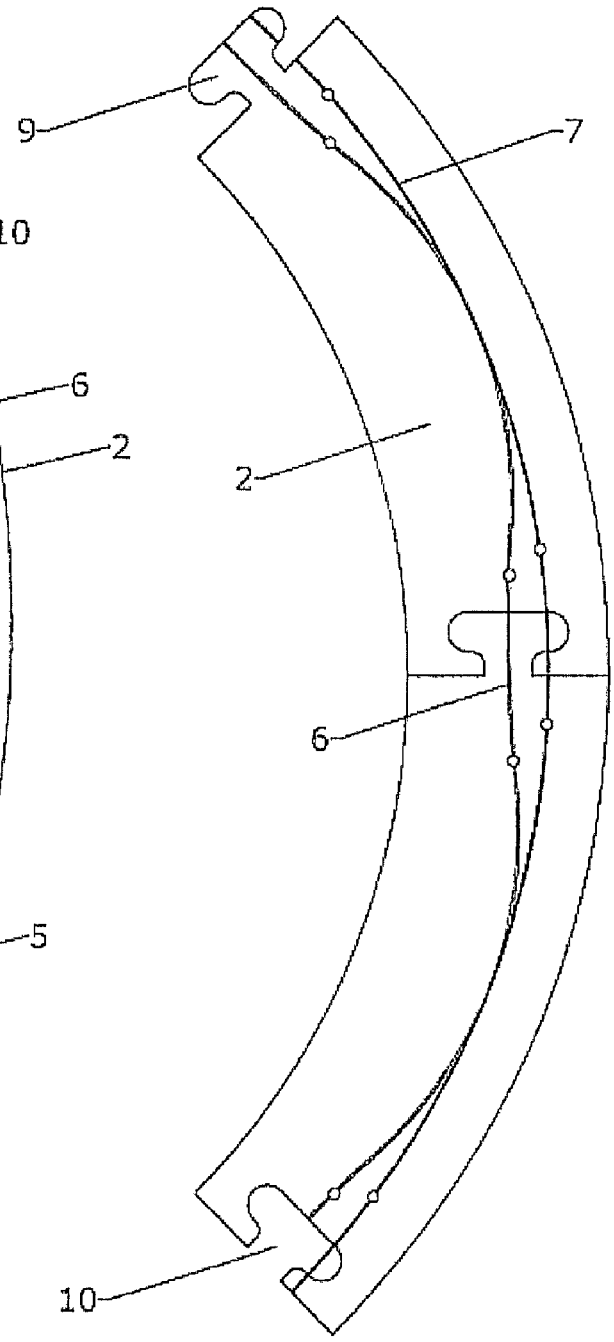
FIG. 2 provides a combination of two identical curved segments for the continuance of a bend.

FIG. 2 shows the combination of two identical curved segments 2 with the continuation of a bend. When making the connection, a seamless form fitting is produced with the two connection elements 9 and 10 and the connection edges 8. The two-part connection groove 6 is partly occupied by a driving wire 7, which in the present case is inserted in the part that runs in the region of the outside curve, parallel to the outer edge. As the special laying of the driving wire in the region of the curve has the purpose of counterbalancing the swinging out of the vehicles in the curve and thereby prevent the vehicles from leaving the predetermined drive path, in the present case of FIG. 2 this would mean that the bend would have to continue on both sides of the figure. When finishing the roadway, the part of the groove 6 not occupied by a driving wire would be caulked over together with the occupied part.

Figure 3:
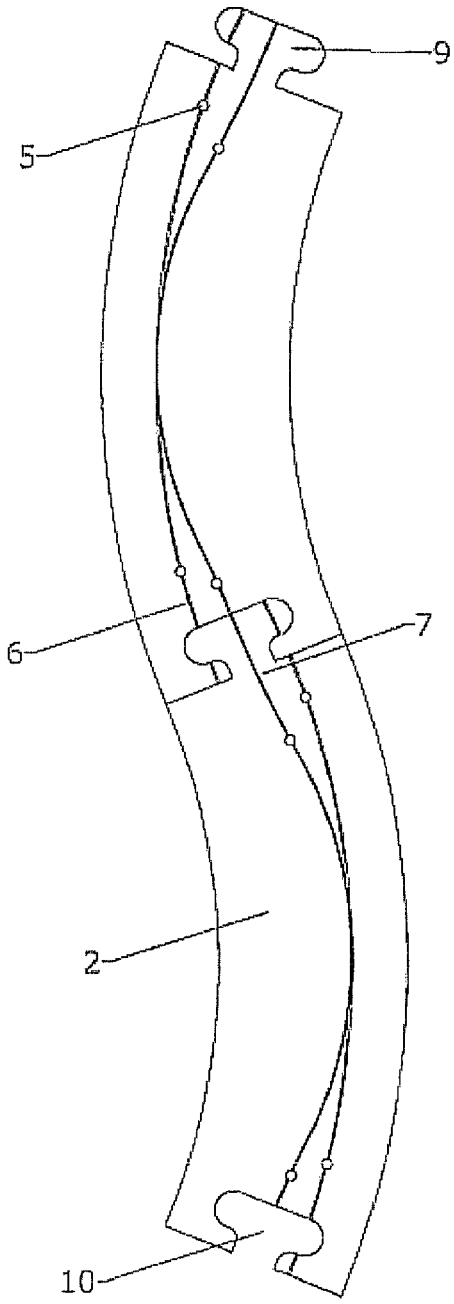
FIG. 3 provides a combination of two identical curved segments on a curve with changing orientation.

FIG. 3 shows the combination of two identical curved segments 2 in a curve with changing orientation. In this case, the laying of the driving wire 7 runs across the middle of the connection edges 8. This would mean for the further course of the roadway (in the direction of travel) that either an opposite curved segment 2 or a straight roadway segment 1 would have to join the section depicted in FIG. 3. Using FIG. 3, another advantageous embodiment of the present invention can also be pointed out, which calls for using the same curved segment 2 for right and left curves, which can be realized if the curved segments 2 have a two-part groove 6 on both two-dimensional sides, so that by turning over (onto the back side) the curved segment 2 the opposite direction of curve is realized.

Figure 4:
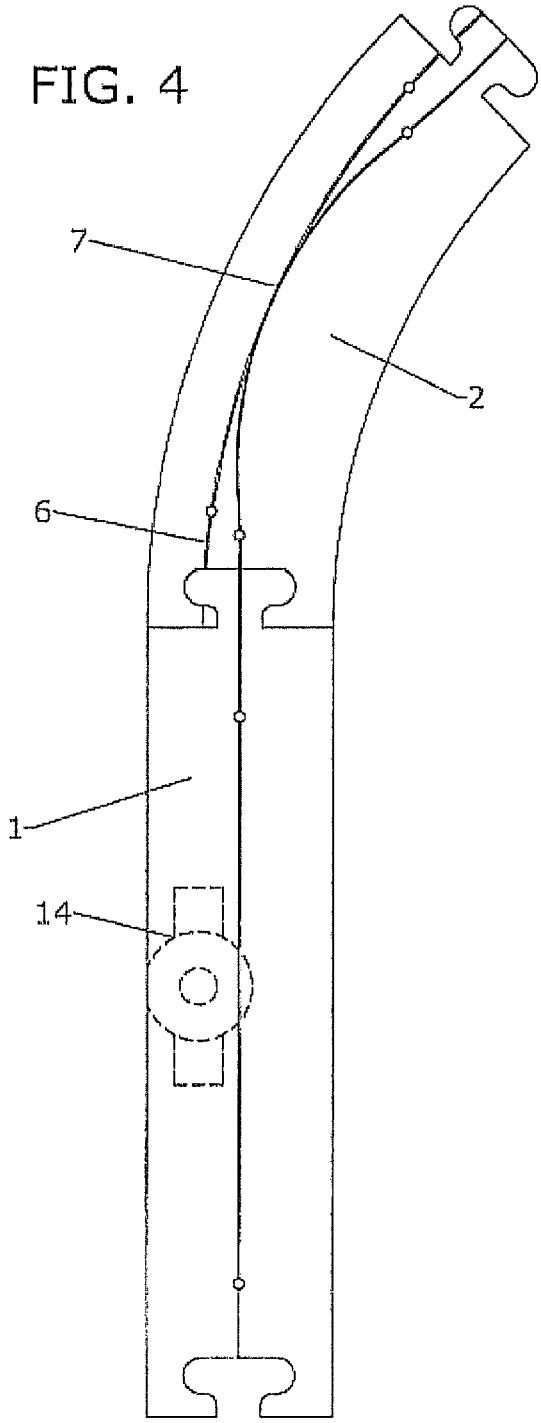
FIG. 4 provides the course of the driving wire in a transition from a straight roadway segment to a curved segment.

FIG. 4 shows the combination of a straight roadway segment 1 with a curved segment 2, where the driving wire 7 in the curved segment 2 remains in the outer part of the groove 6 in the course of the curve, so that the curved segment 2 of FIG. 4 would be joined by another curved segment to continue the bend. On the bottom side of the straight roadway segment 1 there is provided a marking, which cannot be seen in this top view and is therefore shown by dotted line. The marking 14 serves to assure the correct positioning of a magnetic coil for a stopping site.

Figure 5:
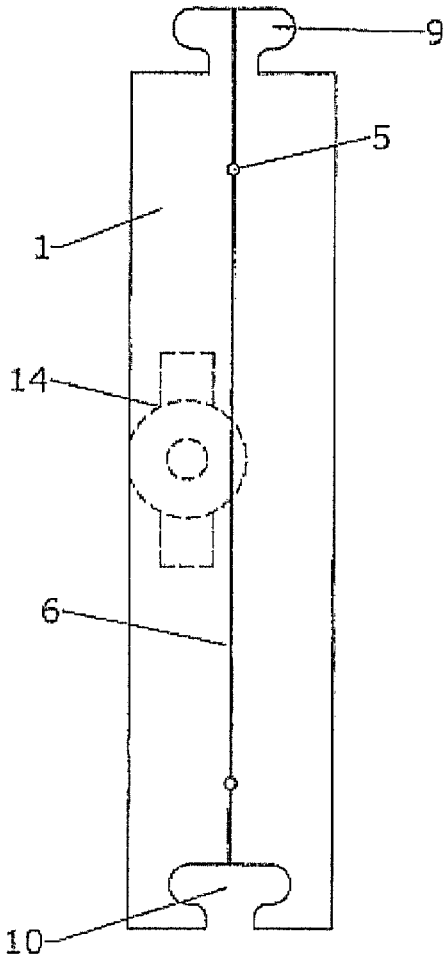
FIG. 5 is a straight curve segment.

In FIG. 5 one sees a straight roadway segment 1 that has two boreholes 5 for possible receiving of so-called reed sensors, with which the traffic flow can be controlled. In principle, it should be pointed out in this context that advantageously all standard roadway segments 1, 2 are outfitted with corresponding boreholes 5, so that such functional elements for the control of the traffic flow can be used in each of the segments as needed. Furthermore, on the back side of the roadway segment 1 there are provided markings 14, shown by dotted line, with which the positioning of coils for the installing of stopping points is predetermined.

Figure 6:
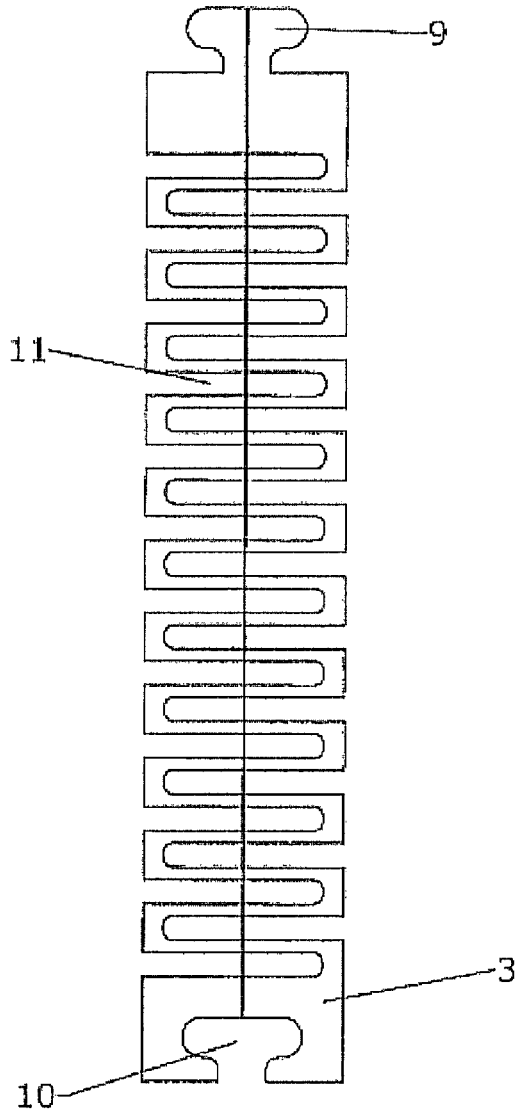
FIG. 6 is a flexible curved segment.

FIG. 6 shows a flexible roadway segment 3, which has a good flexibility in the lateral direction, and flexibility in the vertical direction (for rise and twist) thanks to its serpentine structure with regular recesses 11 operating as flexing means, or means for enabling a flexing of roadway segment 3 relative to a non-flexed resting state, worked into both sides in alternation and extending beyond the middle of the roadway width, so that any given radii can be realized with this roadway segment 3, such as cannot be achieved with the aforementioned standard segments 1, 2. These flexing means may be in any suitable form to enable a twisting, swaying, bending or other movement of segment 3 from a resting state. The width of the flexible roadway segment 3 and the connection elements 9 and 10 are identical to those of the standard segments 1, 2, so that the flexible roadway segments can be combined at will with the standard segments 1, 2. An especially high flexibility can be achieved when one uses a plywood, a substrate, or other support medium (e.g., fiber glass, plastic, etc.) around 3 mm thick as the starting material for the flexible roadway segment.

Figure 7:
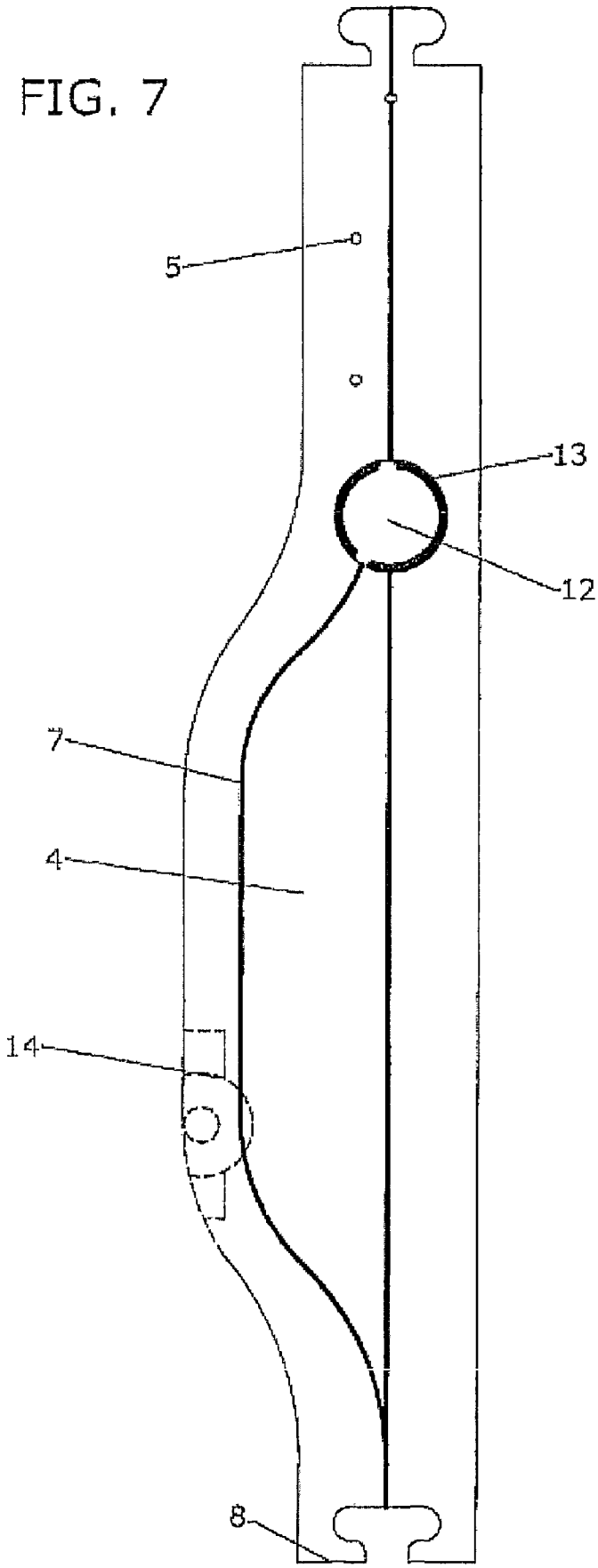
FIG. 7 is an example of a special roadway segment.

FIG. 7 shows a special roadway segment 4, being a switch point in this example, but other examples may be used which could also be used as a bus stop, for example. In the chosen representation, one notices that all grooves 6 are occupied by a driving wire 7, so that the corresponding branches can also be traveled and the desired special functions can be utilized. Furthermore, boreholes 5, a recess region or element 12, a shoulder region or element 13 as well as a marking indicia 14, shown here by non-limiting example as indicated by dotted line are provided for the corresponding functional elements (not shown but including conventional electrical, electrical mechanical, or mechanical) by means of which the traffic flow can be regulated at the switch point or bus stop. In this special roadway segment 4 as well the principle of the invention is realized, that the width of the special roadway segment 4 at least in the region of the connection edge 8 as well as the configuration of the connection elements 9 and 10 is identical to those of the standard roadway segments 1, 2, 3, so that the special segments 4 can also be combined with the standard segments 1, 2, 3 without any problems.

The special roadway segment 4 shown in FIG. 7 was chosen only as a non-limiting example of a plurality of special segments 4, such as junctions, intersections, grade crossings, merging lanes or even complete functional scenarios, and is not to be regarded as a limitation. Those of skill in the art, after study of the inventive disclosure herein, will recognize that the disclosure herein may be modified to alternative special segments 4 without departing from the scope and spirit of the present invention. As a result, a so called special segment 4 for a 'merging lane' not shown in the figures will be understood by those of skill in the art based upon the content herein.

The roadway system of the invention enables in easy fashion the realization of individual roadways for energy-independent scale model vehicles, which follow a driving wire by means of a magnet, and this without creating problems in the planning of the travel routes, the choice of the correct radii and the functional installation of driving wires and functional elements, it being possible to construct both single-lane and multiple-lane roadways by means of the system, so that the problems described at the outset, which exist with the available systems, are solved.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A roadway system for model vehicles having an energy-independent propulsion, a steering axle, and a magnet in a magnetic guidance operable to follow a driving wire laid directly beneath a roadway surface, said system comprising:

a plurality of roadway segments;

each said roadway segment having a support surface proximate an external support and said roadway surface opposite said support surface for supporting said model vehicles during a use of said system;

said roadway surface and said support surface being spaced from each other and defining a thickness direction therebetween, wherein said roadway segments being approximately 1 mm-5 mm in said thickness direction;

at least one groove on said roadway surface shaped to securely receive said driving wire and having a diameter of 0.1 to 1.0 mm; and said plurality of elongate roadway segments are selected from a group of roadway segments including curved roadway segments, flexible roadway segments and special-purpose roadway segments;

said curved roadway segments include at least one curved segment having a two part operative groove;

a first part of said two part operative groove disposed from a middle of one said connection edge outwardly into a region of an outside curve portion of said curved segment and back again to said middle to said middle of opposing other connection edge of said curved segment;

a second part of said two part operative groove disposed aligned with a curved path along an outside curved region of said curved segment: and a portion of said two part operative groove combining along a common path parallel to said outside curved region proximate a middle section of said curved segment.

2. The system according to claim 1, further comprising:

a plurality of base elements each having a thickness of approximately 3.0 mm; and said base elements on said support surfaces of respective said roadway segments, thereby spacing said roadway segments from said external support.

3. The system according to claim 1, further comprising:

connection element means on opposing ends of each respective roadway segment; and respective said connection elements means operative to removably interlock respective ends of said roadway segments during said use.

4. The system according to claim 3, wherein:

said connection element means includes a first connection element on one of said opposing ends of each said respective roadway segment and a second connection element on said other of said opposing ends of each said respective roadway segment;

one of said first and said second connection elements being a protuberance extending beyond a first connection edge;

said other of said first and second connection elements bounding a receiving opening receding from a second connection edge for receiving said protuberance of a corresponding connection element of a corresponding roadway segment during said use; and said first and said second connection elements operatively configured so that respective said connection elements and respective said connection edges engage in a form fit when respective ones of said roadway segments are connected.

5. The system according to claim 4, further comprising:

at least one technical feature on one of said plurality of roadway segments, said at least one technical feature selected from the group comprising: a borehole structure, a shoulder structure, a recess structure, and a marking indicia feature; whereby said at least one technical feature enables operative interaction with at least one of a group comprising an electromagnetic element, an electromechanical element, and an electronic functional element.

6. The system according to claim 5, wherein:

at least one of said plurality of roadway segments further comprises:

at least one of an activation sensor element, a coil element, and a magnetic element, and a traffic regulation sensor element.

7. The system according to claim 1 , wherein:

each said curved roadway segment having an operative arc to form one-eighth of a circumference of a circle; and whereby illustrative projections from a common center of said circle along respective connection edges of respective curved roadway segments form an angle of approximately 45 degrees.

8. The system according to claim 1, further comprising:

at least two different curved segments, whereby each said curve has a cooperative respective radius operative for an edge-to-edge arrangement to form a two-lane roadway alignment.

9. The system according to claim 1, further comprising:

a second groove on said support surface of one of said curved roadway segments, shaped to securely receive a second driving wire, whereby said respective said at least one curved roadway segments enable selection of a preferred left-or-right curve orientation.

10. The system according to claim 1, wherein:

said flexible roadway segments being configured with an operative serpentine structure having a plurality of regular recess on alternating sides of said flexible roadway segment; and a portion of each said regular recess extending across a middle width region of said flexible roadway segment.

11. A system, said system being a roadway system for model vehicles having an energy-independent propulsion, a steering axle, and a magnet in a magnetic guidance operable to follow a driving wire laid directly beneath a roadway surface, said system comprising:

a plurality of roadway segments;

each said roadway segment having a support surface proximate an external support and said roadway surface opposite said support surface for supporting said model vehicles during a use of said system;

said roadway surface and said support surface being spaced from each other and defining a thickness direction therebetween, wherein said roadway segments being approximately 1 mm-5 mm in said thickness direction;

at least one groove on said roadway surface shaped to securely receive said driving wire and having a diameter of 0.1 to 1.0 mm;

said plurality of elongate roadway segments are selected from a group of roadway segments including curved roadway segments, flexible roadway segments and special-purpose roadway segments;

said curved roadway segments include at least one curved segment having a two part operative groove;

a first part of said two part operative groove disposed from a middle of one said connection edge outwardly into a region of an outside curve portion of said curved segment and back again to said middle to said middle of opposing other connection edge of said curved segment;

a second part of said two part operative groove disposed aligned with a curved path along an outside curved region of said curved segment; and a portion of said two part operative groove combining along a common path parallel to said outside curved region proximate a middle section of said curved segment.

12. A system, said system being a roadway system for model vehicles having an energy-independent propulsion, a steering axle, and a magnet in a magnetic guidance operable to follow a driving wire laid directly beneath a roadway surface, said system comprising:

a plurality of roadway segments;

each said roadway segment having a support surface proximate an external support and said roadway surface opposite said support surface for supporting said model vehicles during a use of said system;

said roadway surface and said support surface being spaced from each other and defining a thickness direction therebetween, wherein said roadway segments being approximately 1 nm-5 mm in said thickness direction;

at least one groove on said roadway surface shaped to securely receive said driving wire and having a diameter of 0.1 to 1.0 mm;

said plurality of elongate roadway segments are selected from a group of roadway segments including curved roadway segments, flexible roadway segments and special-purpose roadway segments;

a second groove on said support surface of one of said curved roadway segments, shaped to securely receive a second driving wire, whereby said respective said at least one curved roadway segments enable selection of a preferred left-or-right curve orientation;

said curved roadway segments include at least one curved segment having a two part operative groove:

a first part of said two part operative groove disposed from a middle of one said connection edge outwardly into a region of an outside curve portion of said curved segment and back again to said middle to said middle of opposing other connection edge of said curved segment:

a second part of said two part operative groove disposed aligned with a curved path along an outside curved region of said curved segment: and a portion of said two part operative groove combining along a common path parallel to said outside curved region proximate a middle section of said curved segment.

13. The system according to claim 12, wherein:

each said curved roadway segment having an operative arc to form one-eighth of a circumference of a circle; and whereby illustrative projections from a common center of said circle along respective connection edges of respective curved roadway segments form an angle of approximately 45 degrees.

14. The system according to claim 13, further comprising:

at least two different curved segments, whereby each said curve has a cooperative respective radius operative for an edge-to-edge arrangement to form a two-lane roadway alignment.

* * * * *